United States Patent [19]

Jackson

[11] Patent Number: 4,553,347

[45] Date of Patent: Nov. 19, 1985

[54] GUN TRIGGER ACTUATOR

[76] Inventor: Francis J. Jackson, 2555 Sweetwater Springs Blvd., Spring Valley, Calif. 92077

[21] Appl. No.: 624,052

[22] Filed: Jun. 25, 1984

[51] Int. Cl.[4] ..... F41C 19/00; F41C 19/02

[52] U.S. Cl. ..... 42/69 R

[58] Field of Search ..... 42/1 Y, 69 R, 69 A, 42/69 B

[56] References Cited

U.S. PATENT DOCUMENTS

| | | | |
|---|---|---|---|
| 672,149 | 4/1901 | Hoehn | 42/69 R |
| 1,837,093 | 12/1931 | Andrews | 42/69 R |
| 1,909,425 | 5/1933 | Reid | 42/69 R |
| 2,589,227 | 3/1952 | Colley | 42/69 R |
| 2,607,148 | 8/1952 | Simpson | 42/69 R |
| 2,841,908 | 7/1958 | Bourquin | 42/69 R |
| 2,920,413 | 1/1960 | Marhefka | 42/69 R |
| 3,091,878 | 6/1963 | Savioli | 42/69 R |
| 3,141,254 | 7/1964 | Savioli | 42/70 E |
| 4,499,683 | 2/1985 | Savioli | 42/69 R |

FOREIGN PATENT DOCUMENTS

| | | | |
|---|---|---|---|
| 760735 | 6/1953 | Fed. Rep. of Germany | 42/69 R |
| 110780 | 5/1944 | Sweden | 42/69 R |

*Primary Examiner*—Charles T. Jordan
*Assistant Examiner*—Ted L. Parr
*Attorney, Agent, or Firm*—Ralph S. Branscomb

[57] ABSTRACT

A trigger actuator is used to reduce the pulling force required to fire a gun. A fulcrum is mounted to the trigger guard just below and forwardly of the tip of the trigger, and a lever, pivoted either on the fulcrum or onto an attachment connected to the trigger itself, can be pulled to fire the gun, requiring a small fraction of the force required to pull the trigger directly.

14 Claims, 12 Drawing Figures

GUN TRIGGER ACTUATOR

BACKGROUND OF THE INVENTION

The invention is in the field of guns, and more specifically relates to guns as used in target practice and marksmanship competition, particularly rifles.

A rifle as it comes from the factory will generally have a trigger pull of four or five pounds. When the trigger pull gets down below about two and one half pounds, the gun may become dangerous. At that point, there is such a delicate balance between off and on that the sear can very well slip under any slight jolt; such as closing the bolt on a bullet. This is highly undesirable in any situation, particularly when hunting. For this reason, a standard factory rifle, even when the trigger mechanism is re-worked by a gunsmith, will not have a firing force much under two and a half pounds of pull for safety reasons.

There are special hair triggers, and set triggers, that can be installed in the gun after removing the factory mechanism. These mechanisms can reduce the pull to on the order of two ounces. In all cases, the trigger is only made a hair trigger when the gun is already aimed at the target, eliminating the chance of accident. The second trigger of a set trigger is then set, or the safety is taken off of the hair trigger to enable the marksman to have an extremely fine touch and thus a more accurate shot.

Set trigger mechanisms and other hair trigger devices work very well, but they may cost, for example, $150.00. Taking $350.00 as a good average price for the new rifle, $150 represents a major expense compared with the purchase price of the weapon, and represents a great deal more than many everyday sportsmen are willing to spend, although they would like to have a hair trigger mechanism if such were available at a modest cost.

SUMMARY OF THE INVENTION

The instant invention fulfills the above-stated need by providing a very simple, inexpensive hair trigger mechanism that can be installed on any rifle, and in some embodiments requires no modification of the rifle whatsoever for its use.

It is provided in two basic embodiments. In either case, a pivotal lever is used which presses the lower portion of the trigger rearwardly at a mechanical advantage of between four to one and ten to one. In the first embodiments, the lever is pivoted to a clamp attached to the trigger guard. The lower portion of the lever itself, directly or with an attached pivotal cam or other attachment to the lever, presses against the lower tip of the trigger.

In the second embodiment, the lever is attached to, and pivots relative to, the trigger itself, rather than to the trigger guard. In this embodiment, the fulcrum is mounted to the trigger guard.

In any of the embodiments, the lever itself folds forwardly and down out of the way so that the trigger can be used in its normal mode, and any structure attached to the lever, similarly lies down flat against the top surface of the trigger guard, out of the way of the trigger and permitting ample space to insert the finger in front of the trigger for normal operation. As with any hair trigger, it remains in its normal mode until such time as the marksman is ready to take aim at his target.

DETAILED DESCRIPTION OF THE PREFERRED EMBODIMENT

Figure 11:
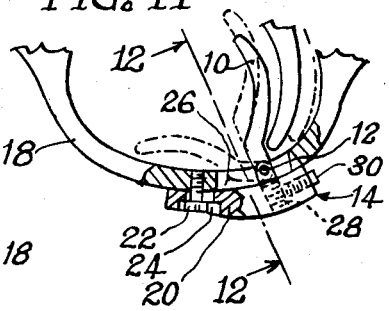
FIG. 11 is a side elevation with portions cut away of yet another embodiment of the invention; and, FIG. 12 is a section taken along line 12—12 of FIG. 11.

One of the simpler embodiments of the lever apparatus portion of the invention is shown in FIG. 11. In FIG. 11, the lever element itself, indicated at 10, is pivoted at 12 to one style of trigger guard clip 14. The lever element 10 is free to flop forwardly as shown in phantom, or can be moved up by the finger into the fire-ready position as shown in FIG. 11. Once in fire-ready position, a very slight travel of the lever will fire the gun, despite its mechanical advantage of up to ten to one. The actuating lever 10 in FIG. 11 is shown mounted to the trigger guard clamp 14, although it could be equally easily be mounted to the alternate trigger guard clamp 16, which requires no milling of trigger guard 18.

Returning to describe the trigger guard clamp 14, however, it has a body or block 20 that fastens to the underside of the trigger guard by means of a bolt 22 which engages the body through a longitudinal slot 24, which permits longitudinal adjustment of the clamp relative to the trigger guard. The lever element itself extends up through a second slot 26, this slot being milled longitudinal in the trigger guard. The lever is attached to the clamp by means of the threaded shaft 28, which is part of the clamp, and which pivots the lever at 12. The purpose of utilizing the threaded shaft is to permit vertical adjustment of the lever up and down as shown in phantom, to adjust the sensitivity by changing the distance between the point of contact with the trigger and the pivot point. Thus, the lever can be rotated 360 degrees either way, and then the resultant position fixed by means of a set screw 30. The guard clamp 14 permits universal adjustment of the lever element, both forwardly and rearwardly and up and down so that the ideal position can be achieved. The only drawback to the clamp 14 lies in the fact that the slot 26 must be milled into the bottom of the trigger guard.

Another type of trigger guard clamp is illustrated in FIGS. 1–6. This trigger guard has a U-shaped member 32 which wraps around the trigger guard and is fastened in place by a plate 34 which screws into the U-shaped member to clamp it firmly in place. Clearly, this design permits longitudinal movement to achieve proper adjustment in this dimension.

The top and rear of the clamp are cut away as indicated at 36 and 38 respectively to accept the lever apparatus when it is in its passive mode as will be described.

Figure 1:
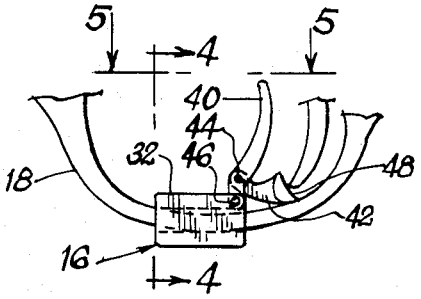
FIG. 1 is a side elevation view of the first embodiment.
Figure 2:
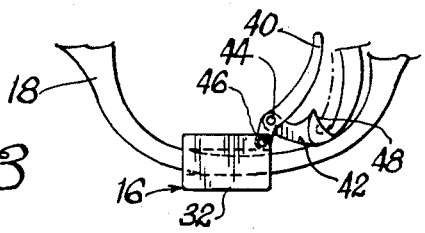
FIG. 2 is identical to FIG. 1 except that the firing movement of the lever is shown.
Figure 3:
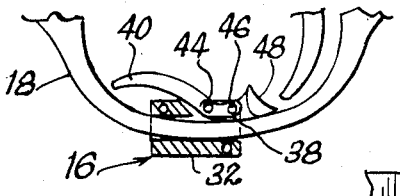
FIG. 3 is a longitudinal section through the trigger guard clamp, showing the trigger guard and trigger in elevation, illustrating the lever actuator apparatus lying down in its passive mode.
Figure 4:
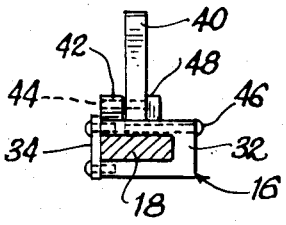
FIG. 4 is a section taken along line 4—4 of FIG. 1.
Figure 5:
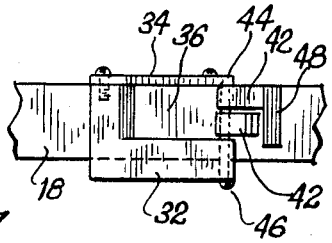
FIG. 5 is a top plan view taken along line 5—5 of FIG. 1.
Figure 6:
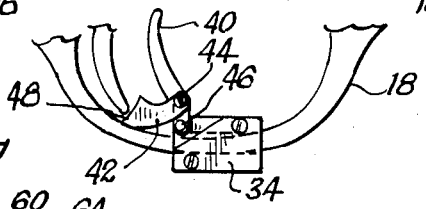
FIG. 6 is a side elevation view of the side of the first embodiment opposite to the side shown in FIGS. 1-3.

Turning now to the lever apparatus itself, in FIG. 1, the lever 40 differs from the lever 10 in that it does not directly contact the trigger. Instead, a rearwardly extended cam element 42 contacts the trigger. The cam element is pivoted to the lever element 40 at 44 so that the cam rides back and forth on the top surface of the trigger guard as the lever 40 is moved back and forth. The lever 40 is pivoted to the clamp 16 at 46. This pivotal connection is best seen in FIG. 5.

The principal purpose of the utilization of the cam 42, rather than the direct contact of the lever element, is to accommodate guns having trigger tips that differ in their spacing from the top surface of the trigger guard from gun to gun. Because the cam has a concave surface 48, it tends to avoid the upwardly wedging action it would otherwise have on shorter triggers, and can span spacing differences between trigger and trigger guard of about one quarter inch, representing the approximate maximum deviation in this dimension from one gun manufacturer to another. By utilizing this cam, there is no need for the upward adjustment of the lever element that was described in relation to the simpler lever mechanism shown in FIG. 11.

Figure 10:
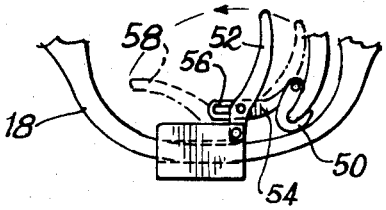
FIG. 10 is a side elevation of yet another embodiment.
Figure 12:
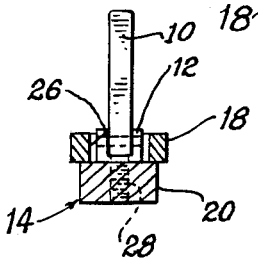

A variation of the cam embodiment is shown in FIG. 10. In this embodiment, rather than utilizing a cam, a cup 50 rides along the top of the trigger guard as the lever element 52 moves back and forth. This trigger cup is connected by means of a pivotal link 54 to the lever element 52. The pivotal link is pivoted at both ends to the respective other elements, and the pivots to the lever element through an elongated slot 56 to provide the lever element with additional forward travel when it is moved into the passive mode as shown in phantom at 58.

The principal function of the cup and connecting link embodiment is to accommodate certain guns that have triggers that move not only rearwardly, but upwardly, as they are pulled. With this pivotal arrangement, it is clear that any combination of rearward and upward movement can be followed by the doubly pivoted cup.

Figure 9:
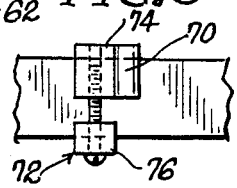
FIG. 9 is a section taken along line 9—9 of FIG. 7.

Thus far, the embodiments have utilized lever elements which pivot to the trigger guard clamp. The embodiment shown in FIGS. 7 through 9 modifies this concept, utilizing a lever which pivots to a clamp mounted to a tip of the trigger itself. In this embodiment, a trigger clamp consists of a connecting arm 60 with a socket 62 at one end which engages the tip of the trigger, and retains the trigger by means of the set screw 64. The forward end of the connecting arm 60 pivotally mounts the lever element 66, at the lower portion of the lever, but above its bottom point 68.

The fulcrum 70 against which the lever element fulcrums is part of a trigger guard clamp 72 which consists essentially of two U-shaped members 74 and 76, member 74 being larger than 76 so that it is wide enough to define the fulcrum 70. Otherwise, the clamping action is exactly the same as with the clamp 16.

Figure 7:
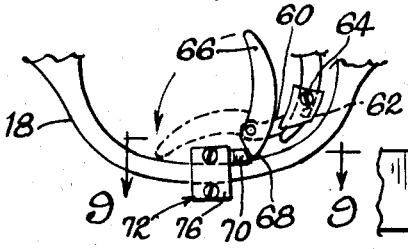
FIG. 7 illustrates a second embodiment of the invention in which the lever element is attached to and pivoted from the trigger itself, and illustrates the passive position of the trigger in phantom.
Figure 8:
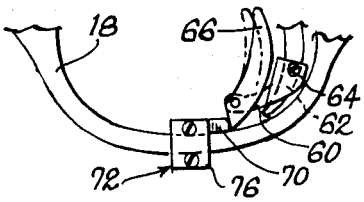
FIG. 8 illustrates the actuator of FIG. 7 in its fired mode.

As is clearly seen in the drawings, when the lever 66 is in the position shown in FIG. 7 and pulls to the position shown in FIG. 8, the trigger is pressed rearwardly and fires the gun. The clamp 72 is naturally longitudinally adjusted before it is clamped into its final position to achieve the optimal (or minimal) play in the lever element before the trigger is fired.

In all of the embodiments, a very simple, easily retrofitted hair trigger arrangement is provided which can be sold for a fraction of the cost of existing hair trigger mechanisms, and is extremely simple to use. Although variations on the basic concept can certainly be conceived which are not expressly shown or discussed in this specification, it is intended that any hair trigger lever which utilizes a mounting on the trigger guard as a fulcrum and a pivotal lever to increase the mechanical advantage of the finger to the trigger, would fall within the spirit of the invention and the appended claims.

I claim:

1. For a gun having a trigger having a firing mode, and a gun body including a trigger guard passing at least partially around said trigger, a trigger actuator for reducing the pulling force required to fire the gun comprising:

(a) a lever apparatus pivoted to said trigger guard at a pivot point adjacent the tip of said trigger and extending upward forwardly of said trigger but close enough to same that a trigger finger can be operatively inserted in front of said lever apparatus clear of said trigger guard;

(b) said lever apparatus being shaped, pivoted, and positioned with respect to said trigger such that said lever apparatus can be pivoted forwardly out of the way of said trigger in a passive mode, or alternatively flipped rearwardly into a fire-ready mode in which a lower portion of said lever apparatus rests against the tip of said trigger without actuating same, and then being pullable into a firing mode in which the lever apparatus is pulled further back to actuate said trigger and fire said gun.

2. For a gun having a trigger having a firing mode, and a gun body including a trigger guard passing at least partially around said trigger, a trigger actuator for reducing the pulling force required to fire the gun comprising:

(a) a lever apparatus;

(b) mounting means for pivotally mounting said lever apparatus on the body of said gun such that said lever apparatus can be pivoted against said trigger to fire same in its firing mode;

(c) said mounting means comprising a clamp which mounts said lever apparatus on the trigger guard of said gun body such that in addition to its firing mode in which the trigger is actuated, it has a fire-ready mode in which it rests against said trigger without actuating same, and a passive mode in which it is pivoted clear of the path of said trigger and of the finger area in front of the trigger necessary for normal firing.

3. Stucture according to claim 2 wherein said clamp engages said trigger guard below and in front of the trigger, and said lever apparatus comprises a single lever element pivoted to said clamp just below the tip of said trigger such that as said lever pivots up against said trigger into the fire-ready mode, a lower portion of said lever adjacent the pivot point thereof contacts the tip of said trigger, with the upper portion of said lever being spaced from said trigger at least until said lever is pulled back into the firing mode.

4. Structure according to claim 2 wherein said clamp comprises a U-shaped bracket clamped around said trigger guard and pivoting said lever apparatus on top of said trigger guard such that no cutting of the gun body including the trigger guard is required.

5. Structure according to claim 2 wherein said trigger guard has a longitudinal slot in the bottom thereof, said clamp is fastened to the bottom of said trigger guard, and said lever apparatus extends up through said slot.

6. Structure according to claim 5 wherein said clamp has a longitudinal slot therein and is fastened to said trigger guard by virtue of a bolt passing through said slot such that longitudinal adjustment of said clamp can be effected by unfastening said bolt, slidably adjusting said clamp relative to the gun trigger, and re-tightening said bolt with the clamp in the adjusted position.

7. Structure according to claim 2 wherein said clamp is longitudinally adjustable relative to said trigger guard to permit accurate longitudinal positioning of said lever apparatus relative to said trigger.

8. Structure according to claim 2 wherein said lever apparatus is adjustably extendable away from or toward said clamp to permit sensitivity adjustments of said lever apparatus by adjusting the distance between the lever apparatus pivot point and the point at which the lever apparatus contacts the tip of the trigger.

9. Structure according to claim 8 wherein said clamp has a clamp body and includes a generally upright threaded shaft threadedly engaged into said body and pivotally mounting said lever apparatus to the top thereof, such that said lever apparatus can be sensitivity-adjusted by rotating said shaft in or out of said clamp body in increments of 360 degrees.

10. Structure according to claim 9 and including a set screw engaged in said clamp body and being operative to freeze the rotational movement of said threaded shaft at any desired position.

11. Structure according to claim 2 wherein said lever apparatus comprises a main lever element which defines the principal pivot point at the bottom end thereof and a cam element pivotal at its forward end to said lever element just above said principal pivot point and extends rearwardly, resting on the top of said trigger guard and defining a camming surface which contacts the tip of said trigger as said lever apparatus is moved from its passive mode into the fire-ready mode.

12. Structure according to claim 11 wherein said clamp defines open areas above said trigger guard to accept said cam element and lever element when said lever apparatus is moved into a forward position clear of said trigger such that said forward position comprises said passive mode.

13. Structure according to claim 11 wherein said camming surface is concave to better accommodate trigger tips variously spaced from the trigger guard.

14. Structure according to claim 2 wherein said lever apparatus comprises a main lever element which defines a principal pivot point at the bottom end thereof, a trigger tip-capturing cup which rides longitudinally on the top surface of the trigger guard and engages the tip of said trigger when moved sufficiently rearwardly, and including a pivotal link pivoted at its forward end to said lever element and pivoted at its rear end to said trigger tip-capturing cup.

* * * * *